US007237680B2

(12) United States Patent
Viny

(10) Patent No.: US 7,237,680 B2
(45) Date of Patent: Jul. 3, 2007

(54) AIR SEPARATOR AND SPLITTER PLATE SYSTEM AND METHOD OF SEPARATING GARBAGE

(76) Inventor: Steven M. Viny, 13695 County Line Rd., Chagrin Falls, OH (US) 44022-4007

( * ) Notice: Subject to any disclaimer, the term of this patent is extended or adjusted under 35 U.S.C. 154(b) by 262 days.

(21) Appl. No.: 10/790,521

(22) Filed: Mar. 1, 2004

(65) Prior Publication Data

US 2005/0205474 A1 Sep. 22, 2005

(51) Int. Cl.
*B07C 5/00* (2006.01)

(52) U.S. Cl. ..... 209/644; 209/638; 209/642; 209/930

(58) Field of Classification Search ..... 209/644, 209/639, 638, 641, 642, 930, 136
See application file for complete search history.

(56) References Cited

U.S. PATENT DOCUMENTS 2,026,910 A * 1/1936 Olsen ..... 209/137
3,014,584 A * 12/1961 Kaufmann ..... 209/617
3,044,619 A 7/1962 Knolle
3,643,797 A * 2/1972 Berkowitz et al. ..... 209/2
3,701,419 A 10/1972 Hutter et al.
3,738,483 A * 6/1973 MacKenzie ..... 209/44.1
4,018,674 A * 4/1977 Morris ..... 209/539
4,191,294 A 3/1980 McGrath, Jr. et al.
4,405,451 A * 9/1983 Roman ..... 209/136
4,490,247 A 12/1984 Forsberg et al.
4,642,977 A 2/1987 Ramacher
5,529,169 A * 6/1996 Wilbur et al. ..... 209/576
5,732,829 A * 3/1998 Smith ..... 209/639
5,934,482 A 8/1999 Smith
6,003,681 A * 12/1999 Wilbur et al. ..... 209/639
6,260,712 B1 7/2001 Flottmann et al.
6,353,197 B1 3/2002 Ulrichsen et al.

* cited by examiner

*Primary Examiner*—Patrick Mackey
*Assistant Examiner*—Mark Hageman
(74) *Attorney, Agent, or Firm*—Howard M. Cohn

(57) ABSTRACT

An air separator system for separating shredded trash into relatively light material and relatively heavy material. An air stream is provided at an end of a conveyor. A splitter plate system comprises a rotating cylinder supported by a frame, and a splitter curtain hanging below the cylinder. The amount of light material which make it over the cylinder into a collection area can be controlled by adjusting at least one of a speed of the conveyor, an angle of the conveyor with respect to horizontal, an angle of the airstream with respect to the angle of the conveyor, a pressure of the airstream, a position of the airstream relative to the end of the conveyor, a distance between the bar and the conveyor, and a height of the bar with respect to a height of the conveyor.

10 Claims, 2 Drawing Sheets

AIR SEPARATOR AND SPLITTER PLATE SYSTEM AND METHOD OF SEPARATING GARBAGE

TECHNICAL FIELD OF THE INVENTION

The present invention relates to method and apparatus for separating a stream of shredded trash into the lighter material, such as paper and light plastic film, and the heavier material, such as polyvinyl chloride containing plastics, textiles and heavier paper material.

BACKGROUND OF THE INVENTION

Separating different types of shredded garbage, or trash items from one another can be very important because certain items of trash can be used or recycled in various ways. For example, ultralight materials, such as paper and light plastics, can be easily composted or used as a fuel. Also, certain items of trash can present hazards (e.g., toxicity, flammability), and must be handled and dealt with appropriately. Many techniques are known for separating items having different sizes, weights, and formed of different materials.

Applicant is not aware of any prior art reference which, in his judgment as one skilled in the art to which the present invention most nearly pertains, would anticipate or render obvious the present invention as set forth below. However, for the purpose of fully developing the background of the invention and establishing the state of the art, the following references are set forth.

U.S. Pat. No. 4,191,294 discloses an empty capsule ejector which is for separating slack-filled capsules from properly filled capsules having the same surface area.

U.S. Pat. No. 5,934,482 discloses an apparatus for separating a mixed granular material into granules of different specific gravities or ranges of specific gravity using a powered air flow. A divider plate is located below the air flow path within the apparatus to separate the two material flows from each other. The divider plate can be rotated (pivoted) about an axis and can also be translated or displaced within the apparatus in order to precisely define the separation point between the material flows. The separation apparatus finds particular utility in the environmental remediation of outdoor firearm training facilities which have been contaminated with lead from used bullets, by allowing the lead bullets to be separated from rocks, soil and other debris for recycling.

A problem with existing air separator and splitter systems is that they are overly complicated, relatively expensive, and usually not portable. And, they are not well suited to the task of separating garbage.

BRIEF DESCRIPTION (SUMMARY) OF THE INVENTION

It is therefore an aspect of the invention to provide an improved air separator and splitter plate system.

According to the invention, an air separator system for separating shredded trash into relatively light material and relatively heavy material comprises a primary conveyor having a conveyor belt wrapping around a roller at an end of the primary conveyor, and conveying the unseparated, shredded trash, in a direction, to the end of the primary conveyor; an air manifold positioned underneath and approximately at the end of the conveyor belt for providing an air stream which is generally in the direction of travel of the conveyor belt; and an adjustable splitter plate system disposed at a position forward of the end of the primary conveyor. The splitter plate system comprises an elongate element which is essentially parallel to the roller at the end of the primary conveyor.

According to a feature of the invention, the elongate element may be a cylinder, and the cylinder may rotate in the same or the opposite direction as the conveyor roller.

According to an aspect of the invention, a splitter sheet hangs below the cylinder. The splitter sheet defines an accumulation area on one side of the splitter sheet which is proximal the conveyor, and an accumulation area on another side of the splitter sheet which is distal the primary conveyor.

According to the invention, a splitter plate system comprises a generally rectangular structural frame having a top elongate element and two opposite side elongate elements extending downwards from opposite ends of the top elongate element, and a bottom elongate element extending between bottom portions of the side elongate elements. The structural frame can form a generally rectangular window with a splitter curtain hanging from bottom ends of the two side elongate elements. The structural frame may be suspended by a chain and pulley system to allow for raising and lowering the structural frame. The structural frame may also move towards and away from the primary conveyor.

According to the invention, a method of separating shredded trash for separating a stream of shredded trash into the lighter material and the heavier material comprises conveying the shredded pieces of material, in a direction, to an end of a conveyor; at the end of the conveyor, providing an airstream in the direction; disposing a bar forward of the end of the conveyor; and collecting the heavier material in a first accumulation area which is proximal the end of the conveyor and the lighter material in a second accumulation area which is distal the end of the conveyor. The bar may be a rotating cylinder.

According to an aspect of the invention, an amount of the lighter material which is collected in the second accumulation area can be controlled by adjusting at least one of the following parameters:

- a speed of the conveyor,
- an angle of the conveyor with respect to horizontal,
- an angle of the air stream with respect to the angle of the conveyor,
- a pressure of the air stream,
- a position of the air stream relative to the end of the conveyor,
- a distance between the bar and the conveyor, and
- a height of the bar with respect to a height of the conveyor.

The air separator and splitter plate system of the present invention is simple to manufacture, simple to set up, relatively inexpensive, portable, and well suited to the task of separating shredded trash, particularly light weight plastic, paper and compost from heavier plastic, textile, glass and paper materials.

Other objects, features and advantages of the invention will become apparent in light of the following description thereof.

BRIEF DESCRIPTION OF THE DRAWINGS

The structure, operation, and advantages of the present preferred embodiment of the invention will become further apparent upon consideration of the following description taken in conjunction with the accompanying figures.

DETAILED DESCRIPTION OF THE INVENTION

Figure 1:
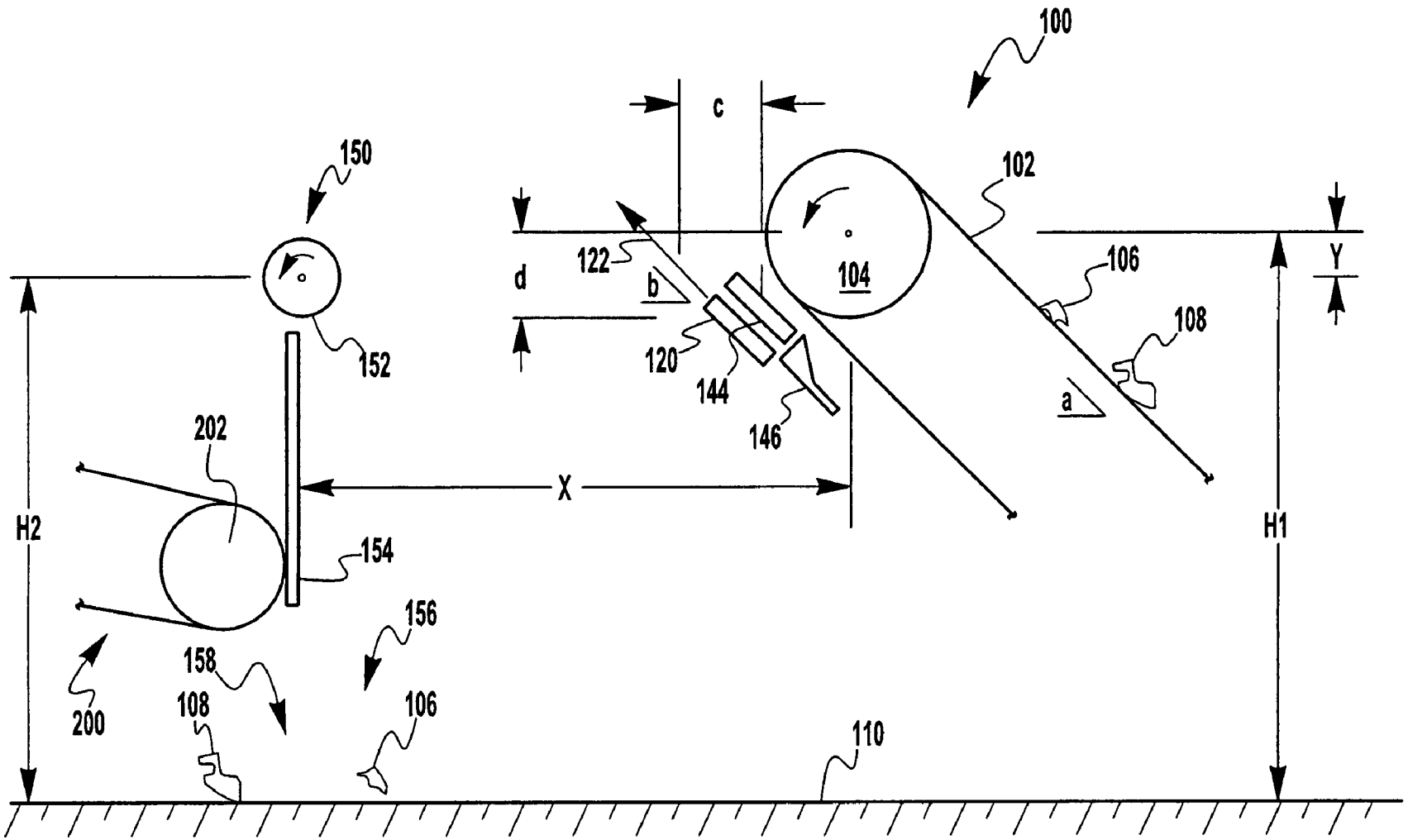
FIG. 1 is a schematic illustration of the air separator system of the invention.

A conveyor belt system 100 has a belt 102 which wraps around a head pulley 104 at the end of the conveyor belt system. The belt 102 carries (conveys) shredded trash (garbage) 106, 108 upwards at an angle "a" with respect to horizontal. In this example, the angle "a" is suitably approximately 30-60 degrees, such as 45 degrees.

The end (left, as viewed) of the conveyor belt system is disposed at a height "H1" above a floor surface 110. In this example, "H1" is 20-30 feet, such as approximately 25 feet.

The conveyor belt 102 has a width of approximately 18 inches to 3 feet, such as 2 feet. In this example, the head pulley 104 has a diameter of approximately 10-12 inches.

The trash 106, 108 includes, for example, plastic, paper and textile material which has first been shredded or size reduced (pre-processed) into small strips, for example no more than about 48 square inches. Generally, the strips of trash should be approximately the same size as one another. They typically include ultralight paper, lightweight plastic film, styrafoam pieces and coffee cup lids. Certainly there will be exceptions, with smaller strips, as well as dust (particles), being mixed in. It is also within the terms of the present invention to separate heavier materials such as pieces of glass from lighter materials such as compost or other lighter weight products, such as by way of example only ultralight paper, lightweight plastic film, styrafoam pieces and coffee cup lids.

The present invention is particularly useful for the task of separating light plastic (polyethylene and styrene) and paper materials 108 such as dry cleaning bags and shopping bags from heavier plastic, such as polyvinylchloride (pvc) containing materials, textile and paper materials 106. In general, light materials 108 will be referred to as "ultralight" and heavier materials 106 will be referred to as "solids".

An air manifold 120 is positioned underneath and approximately at the end of the conveyor belt 102, and blows a stream of air (air stream) 122 (shown as an arrow) generally in the direction of travel of the conveyor belt (i.e., right-to-left, as viewed). The air stream may be directed in a horizontal direction, or it may be inclined at an angle "b" with respect to horizontal which may be the same as, greater than or less than the angle "a" of the conveyor belt 102. The end of the air manifold 120 is a distance "c" in front of (forward of) the end of the conveyor belt system 100, and a distance "d" below the end of the conveyor system. The distance "c" may be either positive or negative (if negative, then the end of the manifold 120 is recessed behind the front of the conveyor system 100), and the end of the manifold may be flush (c=0) with the end of the conveyor system.

A splitter plate system 150 is disposed at a position forward (left, as viewed) of the end of the conveyor belt 102. The splitter plate system 150 includes an elongate element 152 disposed at a distance "X" forward of the end of the conveyor belt 102 and a distance "Y" below the end of the conveyor belt. The elongate element 152 is essentially parallel to the head pulley 104 at the end of the conveyor system 150. In this example, the distance X is 6-12 feet, such as approximately 10 feet, and the distance Y is 1-3 feet, such as approximately 2 feet.

The distance Y represents the difference between H1 (the height of the head pulley 104) and H2 which is the height of the elongate element 152 above the floor surface 110. Typically, H2<H1 (the elongate element 152 is lower than the head pulley 104), but it is with in the scope of the invention that Y can be negative (the elongate element 152 is higher above the floor surface than the head pulley).

In this embodiment, the elongate element 152 is a cylinder which can rotate, and the cylinder 152 rotates in the same direction as the head pulley 104. It is within the scope of the invention that the cylinder 152 rotates in an opposite direction (i.e., clockwise) as the head pulley 104. In this example, the cylinder has a diameter of approximately 4-10 inches.

A splitter sheet 154 hangs below the cylinder 152, as described in greater detail hereinbelow. The splitter sheet 154 can be essentially planar, generally rectangular, and may simply be a sheet (or several parallel overlapping strips) of thick plastic material hanging substantially vertically from beneath the cylinder 152 towards the floor surface 110. A second conveyor system 200 can be disposed on the downstream side of the splitter sheet 154. The splitter sheet 154 is shown extending to the pulley 202. However, it is within the terms of the present invention for the splitter sheet 154 to extend downwards and closer towards the floor 110.

A first accumulation (collection) area 156 is defined as being to the right (as viewed) of the splitter sheet 154 which is proximal the conveyor system 100, and a second accumulation area 158 to the left (as viewed) of the splitter sheet 154 which is distal the conveyor system. The splitter sheet 154 is also referred to as the splitter "curtain".

In use, the conveyor belt 102 is traveling at a rate, which can be controlled, and which can be fast enough that it "throws" the pieces of shredded trash 106, 108 off the end of the conveyor to cause the shredded trash to cascade towards the splitter plate system 150. As the pieces of trash 106, 108 exit the end of the conveyor belt 102, they will be blown by the airstream 122 towards the splitter plate system 150. Ultralight pieces 108 of shredded trash (plastic film and paper) exiting the end of the conveyor belt 102 will travel further, being carried by the airstream 122. The solid pieces 106 of shredded trash, having greater density, will fall into the accumulation area 156, and the ultralight pieces of shredded trash 108, having lesser density, will be projected by the airstream over the cylinder 152 to the conveyor 200 in the accumulation area 158. A useful analogy may be to visualize the dense pieces of shredded trash 106 as rocks, and the light pieces of shredded 108 as feathers. The rotation of the roller or cylinder 152 prevents the burden or buildup on the top of thereof.

Basically, the cylinder or roller 152 is simply a "bar", in the euphemestic sense of "raising the bar". In use, pieces of shredded trash either make it over the bar, or they don't. The splitter sheet 154 is essentially a curtain separating one space from another—keeping things separated from one another. The trash that makes it across the cylinder 152 is preferably carried away by the conveyor 200.

The amount of trash material which makes it over the bar can readily be controlled and adjusted in various ways, including ones or combinations of the following:

- adjusting the speed of the conveyor belt;
- adjusting the angle "a" of the conveyor;
- adjusting the angle "b" of the manifold (i.e., the airstream);
- adjusting the pressure of the airstream;

adjusting the "offset" distances "c" and "d" of the manifold vis-a-vis the end of the conveyor;

adjusting the distance "X" between the cylinder and the roller;

adjusting the height "H2" of the cylinder (which is also adjusting the vertical offset "Y" of the cylinder from the roller);

adjusting the speed and direction of rotation of the cylinder; and changing the surface texture of the cylinder.

Figure 2:
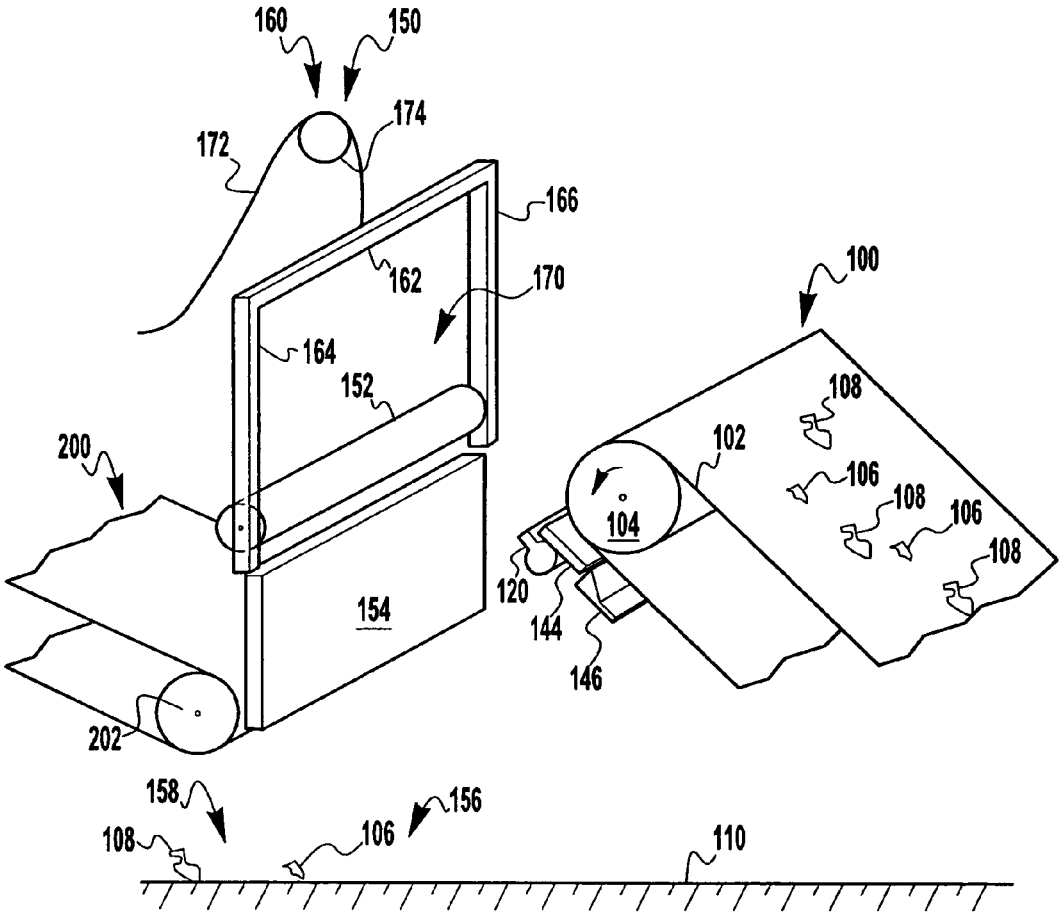
FIG. 2 is a perspective view of the air separator system of the invention.

With reference to FIG. 2, the splitter system 150 includes a generally rectangular structural frame 160 having a top elongate element 162 and two side elongate elements 164 and 166 extending downwards from opposite ends of the top elongate element 162. The elongate element (cylinder) 152 forms the bottom of the frame, and extends between bottom portions, near the ends, of the side elongate elements 164 and 166. In this manner, a generally rectangular "window" 170 is formed, having an exemplary width of 6-8 feet and an exemplary height of 4-6 feet.

The splitter curtain 154 hangs in any suitable manner from the bottom ends of the two side elongate elements 164 and 166, such as by hooks or links. Preferably, there is a minimal gap between the top of the splitter curtain 154 and the surface of the cylinder 152.

The structural frame 160 is suitably suspended by a line (e.g., a chain, a rope) 172 and pulley 174 system to allow for raising and lowering the frame 160, particularly the bar (i.e., the cylinder 152). Alternatively, the cylinder 152 could be supported from beneath, by stands, rather than hanging from above. Or, the cylinder 152 (with curtain 154 hanging therefrom) could be supported in a cantilevered manner by arms extending generally horizontally from the end of the conveyor, in which case the length of the arms would determine the distance "X", and the angle of the arms would determine the offset "Y". It is also within the terms of the invention to hang the structural frame 160 from the ceiling or mount it upon a support structure that is below the cylinder and attached to the floor. If desired, the support structure can be disposed on rails so that the structural frame can move towards and away from the conveyor system 100. Moreover, the structural frame 160 is preferably mounted in each embodiment so that it can move towards and away from the conveyor system 100.

Optionally, the conveyor system 100 may include a dust collector 144 disposed below the head pulley 104, between the head pulley 104 and the manifold 120 so that dust is not carried by the airstream. The conveyor may also include a scraper 146 for cleaning debris off the belt at the beginning of its return journey.

Figure 3:
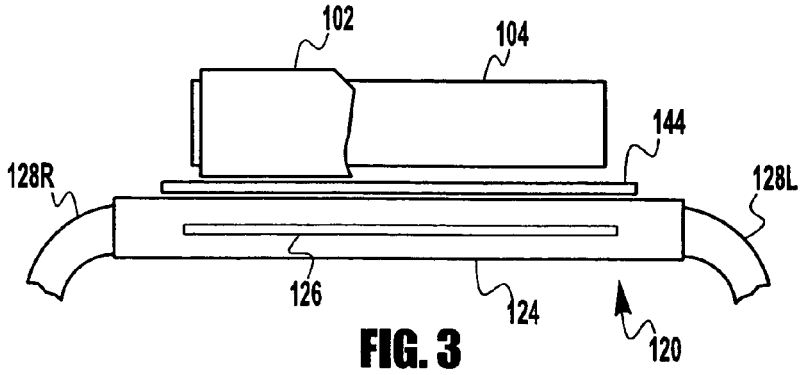
FIG. 3 is an end view of the conveyor of the air separator system of the invention.

As best viewed in FIG. 3, the manifold 120 is disposed underneath the head pulley 104 (belt 102 shown in cutaway for illustrative clarity), and the dust collector plate 144 is disposed between the manifold 120 and the head pulley 104. The manifold 120 suitably includes a plenum 124 and one or more nozzles (exit orifices) 126. Air is suitably supplied to the manifold via air tubes 128L and 128R at the (two) ends of the manifold 120.

The invention has been illustrated and described in a manner that should be considered as exemplary rather than restrictive in character—it being understood that only preferred embodiments have been shown and described, and that all changes and modifications that come within the spirit of the invention are desired to be protected. Undoubtedly, many other "variations" on the techniques set forth hereinabove will occur to one having ordinary skill in the art to which the present invention most nearly pertains, and such variations are intended to be within the scope of the invention, as disclosed herein.

What is claimed is:

1. Air separator system for separating shredded trash into pieces of relatively light material and relatively heavy material, comprising:

a first conveyor system having a conveyor belt wrapping around a roller at one end of the conveyor belt, the conveyor belt having a direction of travel to the roller at the one end, and conveying the pieces shredded trash, in the direction of travel, to the end of the conveyor belt;

an air manifold positioned directly underneath and approximately at the end of the conveyor belt for blowing the pieces of shredded trash as they exit the end of the conveyor belt with an air stream which is generally in the direction of travel of the conveyor belt to the roller at one end;

a splitter plate system disposed at a position forward of the end of the conveyor system comprising a rotatable cylinder which is essentially parallel to the roller at the end of the conveyor belt;

means for adjusting the speed and direction of rotation of the rotatable cylinder; and means for moving the splitter plate system towards and away from the first conveyor system.

2. Air separator system, according to claim 1, wherein:

the roller rotates in a counterclockwise direction; and the cylinder is rotated in the same direction.

3. Air separator system, according to claim 2, further comprising:

a splitter sheet hanging below the cylinder, defining a first accumulation area on one side of the splitter sheet which is proximal the first conveyor system; and a second accumulation area on another side of the splitter sheet which is distal the first conveyor system.

4. Air separator system, according to claim 3, wherein:

the second accumulation area has a second conveyor system for removing the lighter materials that accumulate on the side of the splitter sheet which is distal the first conveyor system.

5. Air separator system, according to claim 1, wherein:

the conveyor belt is disposed at an angle "a" with respect to horizontal; and the angle is approximately 30-60 degrees.

6. A splitter plate system for use in conjunction with a conveyor system for separating shredded trash into pieces of relatively light material and relatively heavy material, comprising:

the conveyor system having a conveyor belt with a direction of travel for conveying the pieces shredded trash in the direction of travel;

an air manifold positioned at the end of the conveyor belt for blowing the pieces of shredded trash as they exit the end of the conveyor belt with an air stream which is generally in the direction of travel;

a structural frame having two side elongate elements and a bottom rotatable cylinder extending between the side elongate elements disposed at a position forward of the end of the conveyor system;

means for adjusting the speed and direction of rotation of the rotatable cylinder;

a splitter sheet hanging from the two side elongate elements; and means for moving the structural frame towards and away from the conveyor system.

7. A splitter plate system, according to claim 6, including: means for raising and lowering the structural frame.

8. A splitter plate system, according to claim 6, wherein:

the structural frame is a generally rectangular structural frame having a top elongate element and two opposite side elongate elements extending downwards from opposite ends of the top elongate element, and a bottom elongate element extending between bottom portions of the side elongate elements, thereby forming a generally rectangular window; and the splitter sheet hangs from bottom ends of the two side elongate elements.

9. Method of separating pieces of shredded trash into relatively light material and relatively heavy material, comprising the steps of:

conveying the pieces of shredded trash, in a direction of travel, to an end of a conveyor having a roller at one end;

blowing the pieces of shredded trash as they exit from the end of the conveyor with an airstream blown from a air manifold positioned directly underneath and approximately at the end of the conveyor belt which is generally in the direction of travel of the conveyor;

disposing a splitter plate system including a rotatable cylinder which is essentially parallel to the roller at the end of the conveyor and a splitter sheet, forward of the end of the conveyor;

adjusting the speed and direction of rotation of the rotatable cylinder; rotating the rotatable cylinder; and moving the splitter plate system with respect to the first conveyor system so that the relatively lighter pieces of material will be projected over the rotatable cylinder for collecting the relatively heavier pieces of material in a first accumulation area on one side of the splitter sheet which is proximal the end of the conveyor and collecting the relatively lighter pieces of material in a second accumulation area on an opposite side of the splitter sheet which is distal the end of the conveyor.

10. Method, according to claim 9, further comprising the steps of:

controlling an amount of pieces which are collected in the second accumulation area by adjusting at least one of the following parameters:

a speed of the conveyor, an angle of the conveyor with respect to horizontal, an angle of the airstream with respect to the angle of the conveyor, a pressure of the airstream, a position of the airstream relative to the end of the conveyor, a distance between the cylinder and the conveyor, and a height of the cylinder with respect to a height of the conveyor.

* * * * *